US005232080A

United States Patent [19]

van Essen et al.

[11] Patent Number: 5,232,080

[45] Date of Patent: Aug. 3, 1993

[54] ARTICLE HANDLING METHOD AND APPARATUS

[75] Inventors: Henk van Essen, Terschuur; Barend van Ravenhorst, Barneveld, both of Netherlands

[73] Assignee: FPS Food Processing Systems B.V., Netherlands

[21] Appl. No.: 849,712

[22] Filed: Mar. 12, 1992

Related U.S. Application Data

[63] Continuation-in-part of Ser. No. 491,055, Mar. 9, 1990, Pat. No. 5,096,041.

[30] Foreign Application Priority Data

Mar. 10, 1989 [NL] Netherlands ..... 8900584

[51] Int. Cl.[5] ..... B65G 47/30

[52] U.S. Cl. ..... 198/418.6; 198/432

[58] Field of Search ..... 198/418.6, 432

[56] References Cited

U.S. PATENT DOCUMENTS

| | | | |
|---|---|---|---|
| 1,973,196 | 9/1934 | Baker | 198/343.1 X |
| 2,551,080 | 5/1951 | Allen et al. | 198/343.1 |
| 2,671,552 | 3/1954 | Miller | 198/343.1 |
| 3,016,665 | 1/1962 | Barrett | 198/418.2 X |
| 3,220,154 | 11/1965 | van der Schoot | 198/570 X |
| 3,224,579 | 12/1965 | Scollard et al. | 209/514 |
| 3,260,348 | 7/1966 | Niederer et al. | 198/432 X |
| 3,661,242 | 5/1972 | Clancy . | |
| 3,850,566 | 11/1974 | Moore | 198/343.1 X |
| 4,086,998 | 5/1978 | van der Schoot | 198/358 |
| 4,383,613 | 5/1983 | van Kettenbroek | 209/514 |
| 4,395,109 | 8/1983 | Nambu . | |
| 4,569,444 | 2/1986 | McEvoy et al. . | |
| 4,603,772 | 8/1986 | Tomosue | 198/418.6 |
| 4,708,250 | 11/1987 | van der Schoot . | |

FOREIGN PATENT DOCUMENTS

| | | |
|---|---|---|
| 0048525 | 3/1982 | European Pat. Off. . |
| 1303722 | 5/1973 | Fed. Rep. of Germany . |
| 1169743 | 3/1957 | France . |
| 2519614 | 7/1983 | France . |
| 67-17724 | 7/1969 | Netherlands . |
| 81-03133 | 1/1982 | Netherlands . |
| 83-00287 | 2/1984 | Netherlands . |
| 1598749 | 9/1981 | United Kingdom . |

*Primary Examiner*—D. Glenn Dayoan
*Attorney, Agent, or Firm*—Larson and Taylor

[57] ABSTRACT

A method and apparatus for transferring discrete articles at a receiving and packing station from a randomly supplied conveyor having articles with a plurality of characteristics to a take away conveyor having articles with only certain selected characteristics out of the plurality of characteristics. At each receiving and packing station, the articles having the selected characteristics are transferred from the supply conveyor to a collecting device to form therein a completed row of a certain number of articles. An endless transfer conveyor has a plurality of rows of article holders, each of which, at one point in its travel, is positioned to receive a completed row of articles from the collecting device. The collecting device will deliver a complete row of articles only into an empty row of holders in the transfer conveyor. The transfer conveyor then transfers a completed row of articles to containers on a take away conveyor. A receiving mechanism may be interposed between the transfer conveyor and the containers to receive and lower articles to the containers.

16 Claims, 11 Drawing Sheets

ARTICLE HANDLING METHOD AND APPARATUS

RELATED APPLICATION

This application is a continuation-in-part of U.S. application Ser. No. 07/491,055, filed Mar. 9, 1990, now U.S. Pat. No. 5,096,041.

FIELD OF THE INVENTION

This invention relates to the handling of discrete articles, and it relates in particular to a method and apparatus for handling such articles which have only certain selected characteristics, taken from a supply source having articles with a wider range of characteristics.

BACKGROUND OF THE INVENTION

In many different environments, discrete articles having a wide range of characteristics are sorted, following which groups of such articles having only certain selected characteristics are handled separately. One such environment of particular interest is the handling of articles of food such as eggs, fruits and vegetables such as apples, oranges, tomatoes, kiwis, peppers, etc. Such food articles present particular difficulties because of their fragility, coupled with the need to handle such articles with an increasingly higher speed. Achieving higher speed is especially difficult in the case of relatively fragile articles such a eggs.

Numerous systems have been known for many years for the automatic handling of eggs. In these systems the eggs first pass through preliminary steps including washing, inspecting for quality, weighing for size, and possibly also, inspecting for color, followed by sorting out of eggs having certain selected characteristics such as grade and weight and then packaging same. Examples of said systems are shown in prior U.S. patents including Scollard U.S. Pat. No. 3,224,579, Reading U.S. Pat. No. 3,342,012, van Kettenbrock U.S. Pat. No. 4,383,613 and McEvoy U.S. Pat. No. 4,569,444.

Notwithstanding the existence of numerous known egg handling systems, the need continues to exist for a new and improved article handling method and apparatus, particularly for food articles, and especially eggs, which will permit increased capacity in the sorting and packaging of such articles.

SUMMARY OF THE INVENTION

It is a purpose of the present invention to provide a new and improved system for handling discrete articles such as food articles which system has enhanced capabilities relative to previously known arrangements.

In accordance with the method and apparatus of the present invention, articles such as eggs, after being washed, inspected and weighed, are randomly supplied to a supply conveyor from which eggs having certain selected characteristics, for example a certain grade and size, are separated out for packaging at a receiving and packaging station.

An increased capacity of the overall system can result from an increase in the speed and capacity of the supply conveyor. However, such enhancements of the supply conveyor are of little value if the receiving and packaging station is not equipped to effectively convert such an increase in supply conveyor capacity into an increased capacity in the actual packaging of the eggs which are sorted out at that station.

The present invention achieves these goals by providing an improved article receiving and packaging station which can receive more articles from a supply conveyor and effectively package those articles more rapidly.

In accordance with the present invention, after articles such as eggs have been inspected, cleaned, weighed and supplied randomly to a supply conveyor, they pass over improved receiving and packaging stations in accordance with the present invention, whereat eggs having selected characteristics are separated out and efficiently and effectively handled and packaged.

The supply conveyor itself preferably has a plurality of parallel tracks of egg holders, each track being able to release eggs independently of the other tracks, and thereby acting essentially like a separate conveyor, thereby increasing the capacity of the supply conveyor by a multiple of the number of tracks.

At the packaging and receiving station, in accordance with the present invention, eggs having the selected characteristics are transferred from the supply conveyor, independently from each other track of the supply conveyor, into respective rows of article holders in a collecting device which has one row of article holders for each track of the supply conveyor. With the characteristics and position of every single egg stored in a computer, together with information concerning the availability of spaces within every holder of the collecting device, eggs having the certain selected characteristics are released into available holders in the collecting device until each row of holders is completely filled with eggs.

There is provided beneath the collecting device an endless transfer conveyor having a series of rows of article holders moveable along an upper run beneath the rows of article holders of the collecting device. When the central processor knows that there is a full row of eggs in the collecting device and an empty row of holders in the transfer conveyor moving therebeneath, the full row of articles is released from the collecting device into said row of holders on the transfer conveyor.

When the rows of article holders on the transfer conveyor move around to the lower run thereof, the central processor knows the availability to receive a row of eggs either in a container on a take away conveyor located therebeneath or, in a different embodiment, in a receiving mechanism arranged to receive eggs from the transfer conveyor and lower them into a row in a container on the take away conveyor.

It is a feature of the present invention that the transfer conveyor has a capacity exceeding that of the collecting device so that if, for any reason, the take away conveyor momentarily cannot receive articles from the lower run of the transfer conveyor, those rows of eggs need not be released. Owing to the increased capacity of the transfer conveyor, unless the backup of the take away conveyor becomes quite substantial, the transfer conveyor can continue to receive rows of eggs from the collecting device such that the latter can continue receiving articles from the supply conveyor, with the result that the supply conveyor can continue its movement without an interruption, notwithstanding backups at the take away conveyor. In this sense, the transfer conveyor acts as a buffer.

In the preferred embodiment of the present invention, the transfer conveyer is continuously moving and has a series of rows of article holders moveable along an upper run beneath the rows of article holders of the collecting device.

It is a feature of this preferred embodiment of the present invention that the continuously moveable endless transfer conveyor has a capacity exceeding that of the collecting device so that if, for any reason, the take away conveyor momentarily cannot receive articles from the lower run of the transfer conveyor, those rows of eggs need not be released, but instead can continue around the transfer conveyor. Owing to the increased capacity of the transfer conveyor, unless the backup of the take away conveyor becomes quite substantial, the transfer conveyor can continue to receive rows of eggs from the collecting device such that the latter can continue receiving articles from the supply conveyor, with the result that the supply conveyor can continue its movement without an interruption, notwithstanding backups at the take away conveyor. In this sense, the transfer conveyor acts as a buffer.

In accordance with another embodiment of the present invention, the endless transfer conveyor moves intermittently, the transfer conveyor being mounted on a reciprocating carriage such that the two runs of the transfer conveyor may have different motion characteristics, preferably each run having a separate drive unit. In one form of this second embodiment of the invention, the upper receiving run of the transfer conveyor travels intermittently by increments of a number of article holder distances equal to the number of supply devices while the lower, discharging run of the transfer conveyor travels intermittently by increments of a number of article holder distances equal to the number of receiving mechanisms. In accordance with a further aspect of this second embodiment of the invention, the upper run of the transfer conveyor travels intermittently by increments of a number of article holder distances equal to the number of actively functioning supply devices (that is, the supply devices need not all be active, but may for example stand still, be empty or the like) and the lower run of the transfer conveyor travels intermittently by increments of a number of article holder distances equal to the number of actively functioning receiving mechanisms.

A further possibility of this second embodiment of the present invention is that the upper run of the transfer conveyor travels intermittently by increments of a number of article holder distances equal to the number of supply devices while the lower run of the transfer conveyor discharges articles in a continuous movement.

A further possibility in the operation of this second embodiment of the invention is that the transfer conveyor is arranged to function also as an article buffer, i.e., such that the upper run can receive a number of articles without the lower run discharging the same number of articles in a given period of time.

In this second embodiment of the invention, the various motion characteristics of the two transfer conveyor runs as well as the buffer function may be brought about by a carriage mounting reversing rollers, the carriage being moveable in a fixed frame. The two conveyor runs may be driven by two drive means mounted in the carriage and running parallel to the transfer conveyor, each drive means having its own drive shaft mounted in the fixed frame, the first of which drives the upper run and the other of which drives the lower run, each run thereby being driven in accordance with desired driving characteristics.

The desired driving characteristics can be achieved in a simple manner by means of commercially available indexing units, camming mechanisms or electromagnetically or mechanically controlled clutches or stepping motors.

The present invention also includes the provision of improved individual article holders having a plurality of generally flat inwardly tapering surfaces adapted to resiliently receive articles delivered to the holders in any direction.

It is therefore an object of the present invention to provide a new and improved article transfer method and apparatus for receiving articles from a randomly supplied conveyor and effectively delivering articles having selected characteristics from the supply conveyor to a take away conveyor.

It is another object of the present invention to provide a new and improved receiving and packaging station which includes an endless transfer conveyor for receiving articles from a collecting device located between itself and a supply conveyor and for delivering articles to containers on a take away conveyor, the transfer conveyor having an increased capacity so as to act as a buffer to receive more articles from the collecting device then it can momentarily deliver to the take away conveyor.

It is another object of the present invention to provide a new and improved method for handling articles such as eggs wherein articles having selected characteristics are taken from a supply conveyor and effectively and efficiently handled for packaging.

It is still another object of the present invention to provide a new and improved method and apparatus wherein the overall capacity of the article handling apparatus is enhanced by increasing the capacity of the supply conveyor in cooperation with a receiving and packaging station adapted to cooperate with the supply conveyor of increased capacity by receiving articles from the respective tracks of the supply conveyor independently of each other and efficiently handling same within the receiving and packaging station to enhance the speed of packaging of such articles.

These and other objects of the present invention will become apparent from the detailed description to follow.

BRIEF DESCRIPTION OF THE DRAWINGS

There follows a detailed description of preferred embodiments of the present invention, to be taken together with accompanying drawings, wherein.

DETAILED DESCRIPTION OF THE PREFERRED EMBODIMENTS

There follows a detailed description of preferred embodiments of the present invention wherein like numerals represent like elements throughout the several views.

As discussed above, the transfer method and apparatus of the present invention has utility for the handling of virtually any kind of article wherein articles of numerous characteristics are randomly supplied to a supply conveyor and from which articles having only selected characteristics are to be taken from that supply conveyor and handled, for example packaged, at a given location.

The present invention is particularly suitable for the handling of food articles such as eggs, apples, tomatoes, kiwis, peppers, etc. However, since the primary application of the present invention relates to the handling of eggs, the preferred embodiment will be described below particularly with respect to eggs. However, it is to be understood that the present invention is suitable for use with other discrete articles, including especially different discrete food articles.

Figure 1:
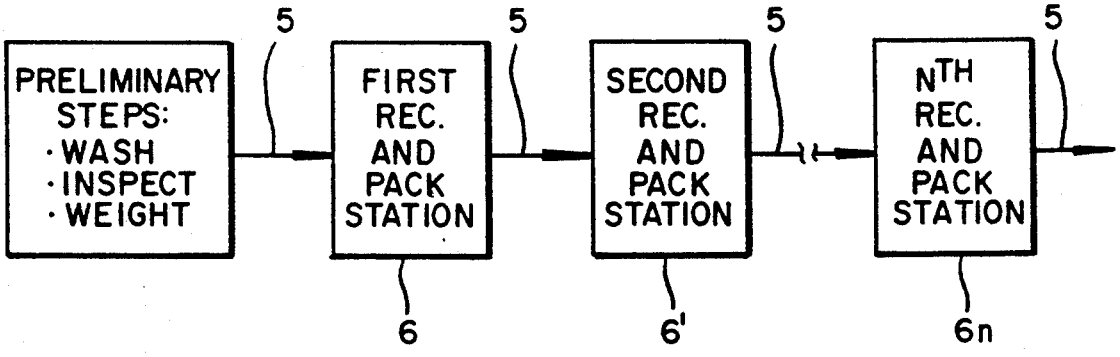
FIG. 1 is a diagrammatic view illustrating an overall article handling system of which the present invention forms a part.
Figure 2:
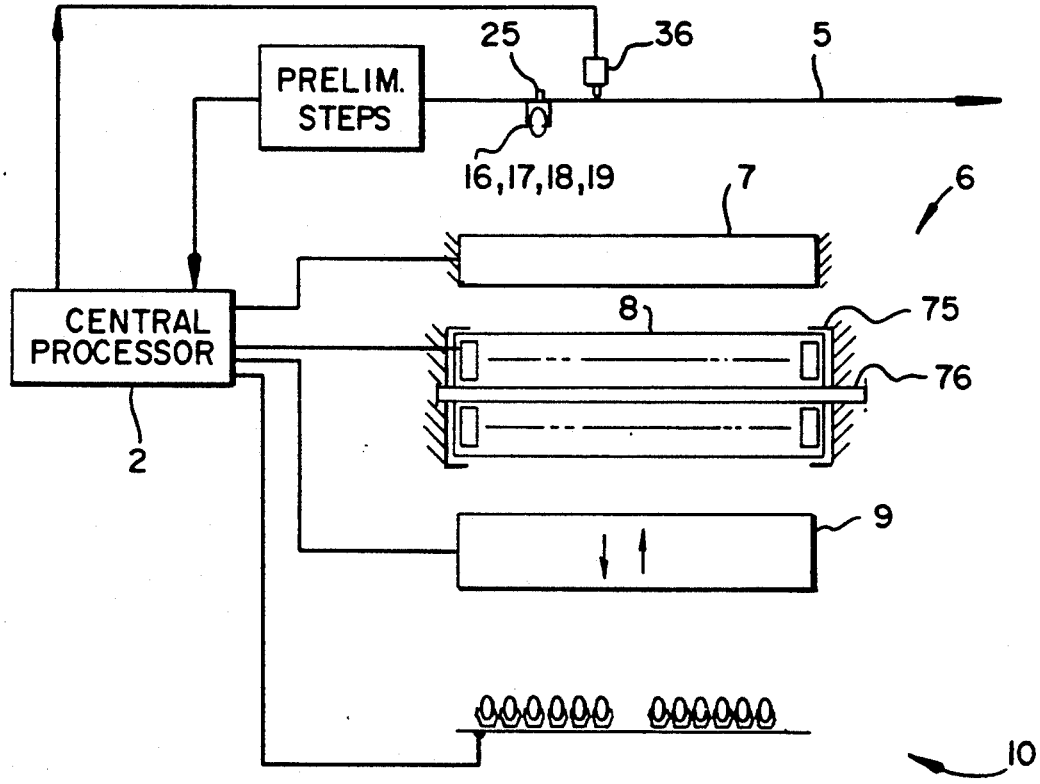
FIG. 2 is a diagrammatic view illustrating the operation of the present invention.

FIG. 1 illustrates schematically an overall egg handling system of which the present invention would form a part. Eggs received from the farms undergo a number of preliminary steps including washing, visual inspection for defects and color by a procedure known as candling, and individual weighing of each egg. Referring to FIG. 2, it is a basic feature of systems of this type that upon completion of the preliminary steps, the condition of each egg, e.g. the quality, color and weight of each egg, as well as its location throughout the remainder of the system, is stored in a central processor 2. After the preliminary steps, each individual egg is supplied in random fashion to a supply conveyor 5. While the eggs are supplied randomly to the supply conveyor 5, information stored in the central processor 2 with respect to each individual egg will permit subsequent disposition of each individual egg in accordance with predetermined parameters.

With each individual egg thus washed, inspected and weighed, and with all relevant information stored in the central processor 2, the eggs then move along the supply conveyor 5 to be released and subsequently handled at each one of a plurality of receiving and packing stations 6, 6'. . . 6*n* wherein each receiving and packing station handles eggs of certain selected characteristics. An egg handling apparatus of this type might have as many as twelve different receiving and packing stations.

FIGS. 3 through 7 illustrate one of these receiving and packing stations 6. For example, this particular station might be programmed to receive and pack only eggs of Grade A quality and of "large" size.

Figure 3:
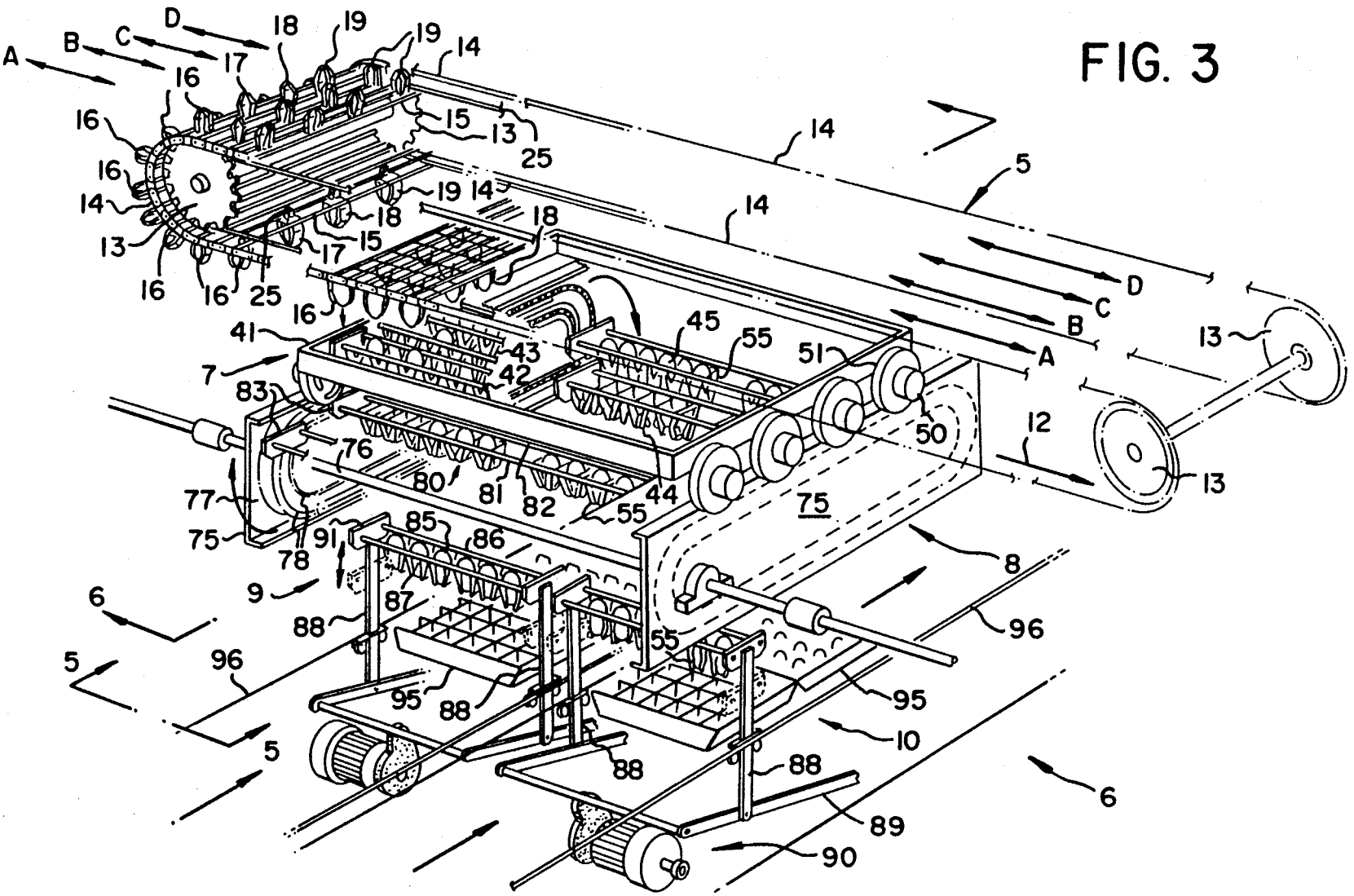
FIG. 3 is a perspective view of an overall receiving and packing station which incorporates the features of the present invention.

To discuss the operation of this receiving and packing station in its most general terms, eggs from the preliminary steps arrive at the receiving and packing station 6 from the upper left hand portion of FIG. 3 in holders 16, 17, 18 and 19 of supply conveyor 5, with the eggs on the lower portion thereof moving in the direction of arrows 12 from left to right.

The eggs to be handled at this station 6 are released while passing over a collecting device 7, whereby individual eggs fall into individual article holders formed within this collecting device 7. Mounted beneath collecting device 7 is an endless transfer conveyor 8. In the preferred embodiment of the present invention, as shown in FIGS. 2–6 this transfer conveyor moves continuously, while in a second embodiment, described below, it moves intermittently.

Figure 4:
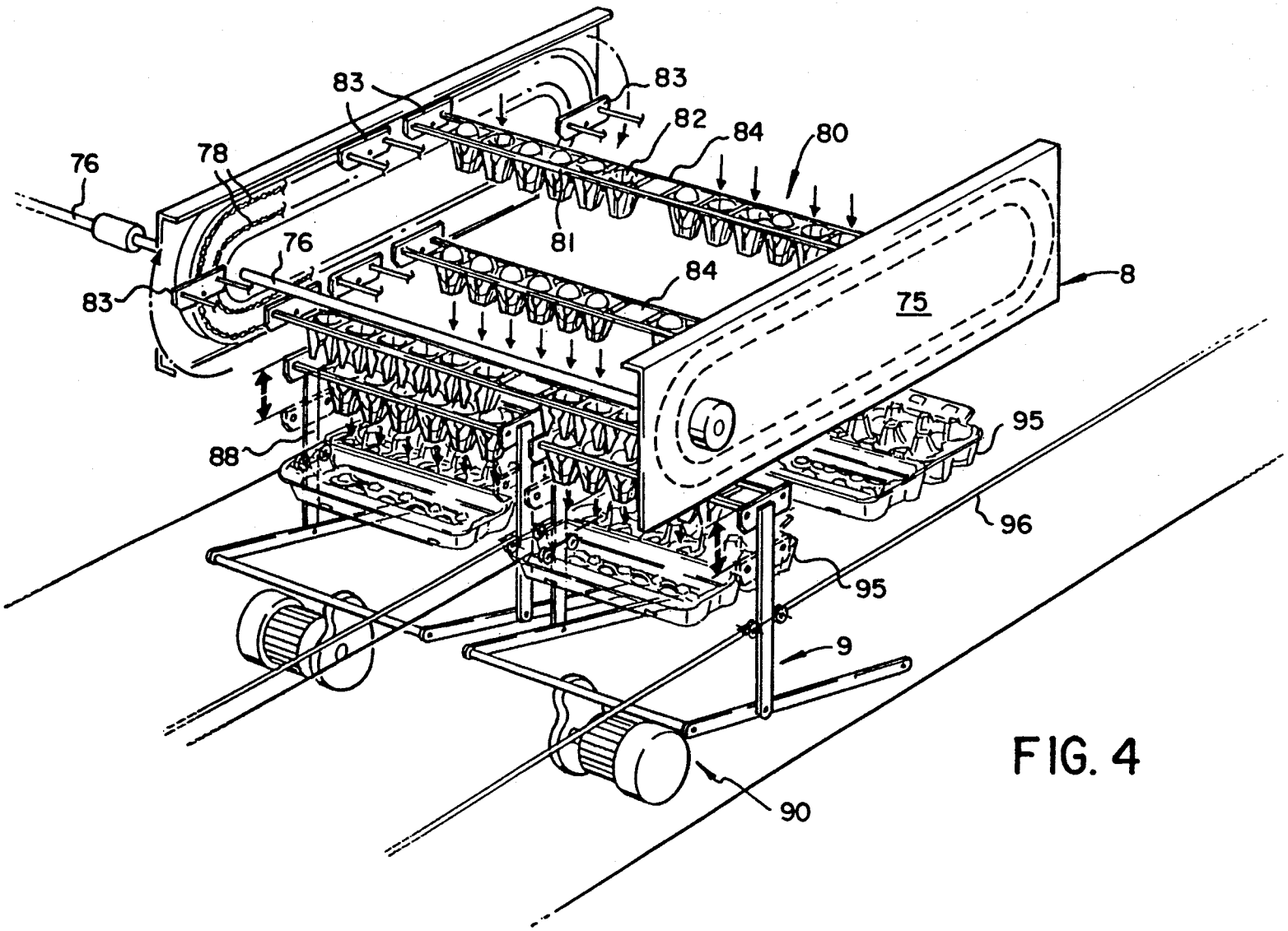
FIG. 4 is a perspective view similar to FIG. 3, but with parts removed to reveal further details.

Transfer conveyor 8 has a series of rows of article holders extending parallel to the rows of article holders of the collecting device 7. These article holders move continuously along the endless path formed by the double endless chain 78. The mounting of the rows of article holders in transfer conveyor 8 assures that these article holders are maintained in an upright condition at all times. Such a conveyor chain mechanism for accomplishing this is shown, for example in U.S. Pat. No. 3,297,139 to Spiegle. Eggs received along the upper run of the transfer conveyor 8 are then discharged from the lower run thereof into containers 95 mounted on take away conveyor 10; but preferably instead of being dropped directly into the containers, the eggs are dropped into rows of article holders in a receiving mechanism 9 which then lowers the eggs to the containers 95 to reduce the chances of breakage. Of course for articles other than eggs, wherein breakage is less of a factor, the receiving mechanism 9 may not be as necessary. FIGS. 3 and 4 show different kinds of containers 95. FIG. 3 shows large containers for commercial customers, while FIG. 4 shows the conventional home use twelve pack box.

The supply conveyor moves in the direction of the arrows 12 so that the eggs move over the station 6 from left to right. The conveyor 5 is, of course, much longer than as indicated in FIG. 3 since FIG. 3 shows only the portion thereof over the station 6 plus the left and right hand ends thereof. The supply conveyor 5 includes end pulleys 13 on which are mounted drive chains 14. Extending across the width of the conveyor 5 are sets of support rods 15 arranged in pairs and each mounting a plurality of article holders 16, 17, 18 and 19. All of the article holders 16 are arranged in a common plane parallel to the direction of travel of the supply conveyor, all of these article holders 16 thereby forming a first supply track A. Similarly, all of the holders 17 are arranged in a common parallel plane B forming a second track of holders, while holders 18 lie in a plane forming a third track C and holders 19 lie in a fourth plane forming supply track D. Any given machine may include as many or as few tracks as desired.

Figure 5:
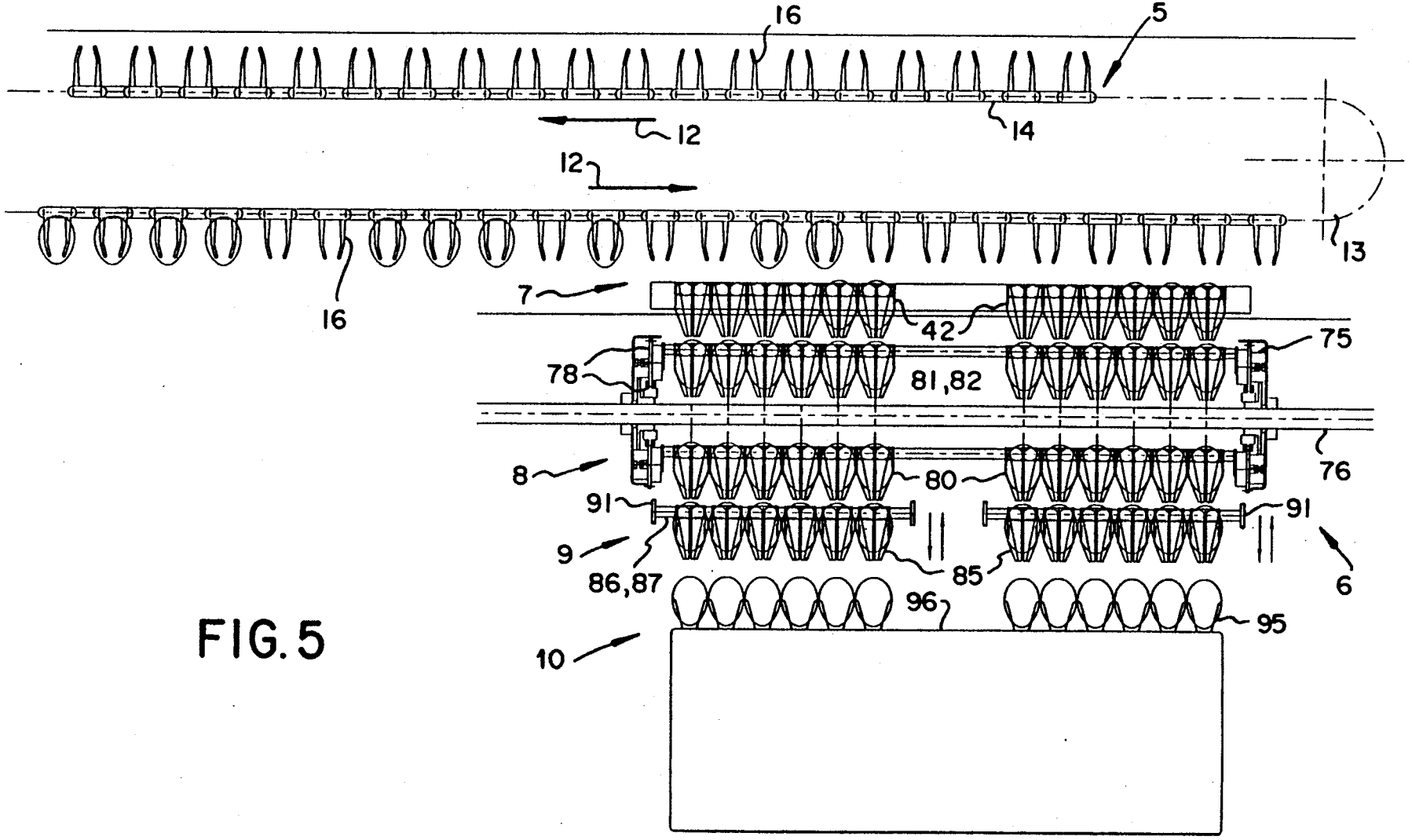
FIG. 5 is a side elevational view taken in a vertical plane through line 5—5 of FIG. 3.
Figure 6:
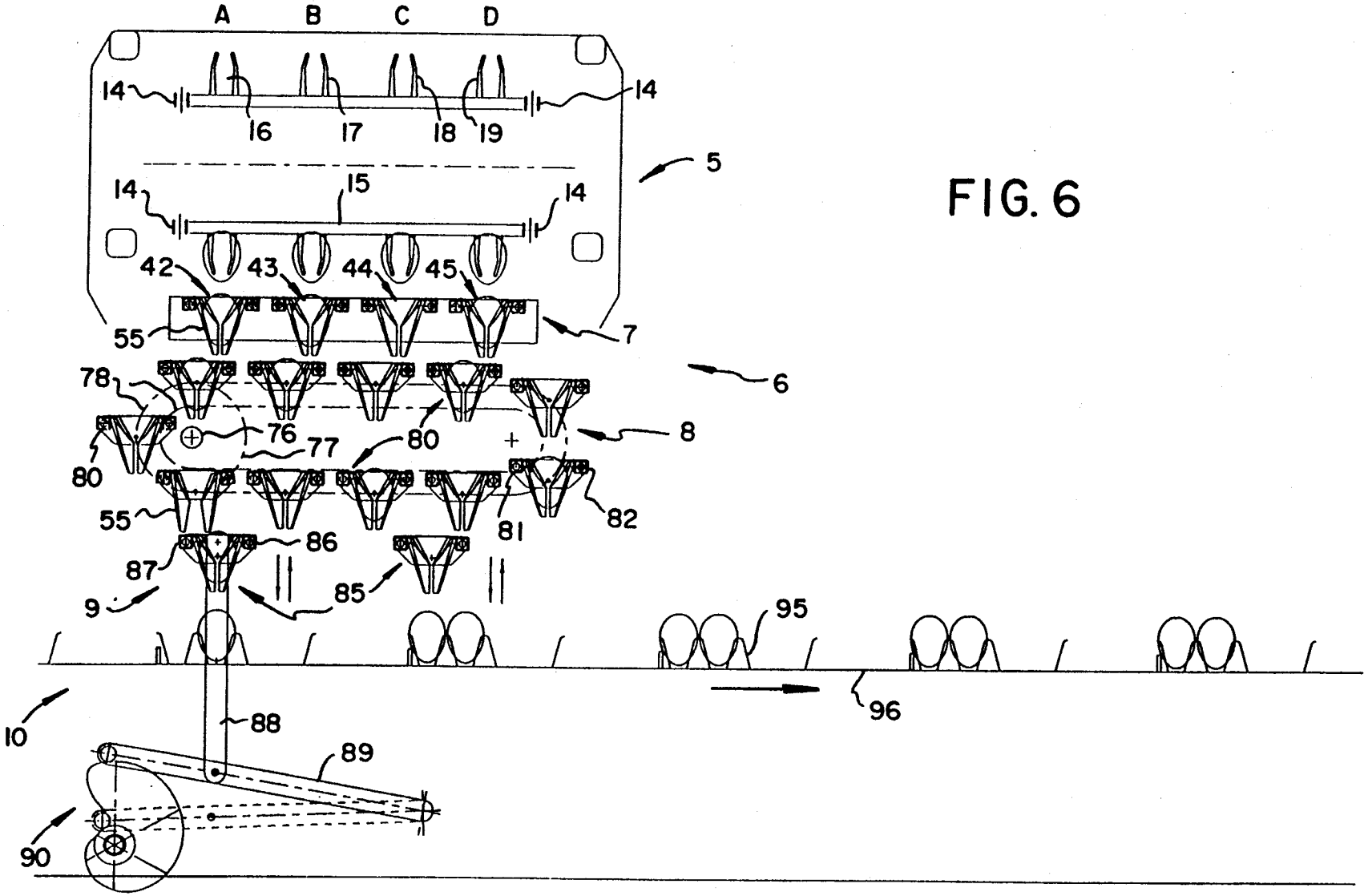
FIG. 6 is a schematic cross-sectional view taken in the plane of line 6—6 of FIG. 3.

Referring to FIGS. 3 and 6, the collecting device 7 includes one row of article holders corresponding to each of the tracks A, B, C, D. For the track A, device 7 includes a row of article holders 42 (shown also in FIG. 5) which includes twelve holders, six on each side of a central vertical plane through device 7. In FIG. 3, only the left-hand portion of this row of holders 42 is shown, the right-hand portion of row 42 being omitted for purposes of illustration. However, both the left and right-hand portions of row 42, i.e. all twelve holders, are visible in FIG. 5.

Track A will be described in detail, and with the understanding that tracks B, C, and D operate identically thereto. All of the eggs in holders 16 have been supplied thereto randomly. However, the selected characteristics, e.g. the quality and size of each egg in each holder is known, this information being stored in the central processor 2 (FIG. 2). Accordingly, as the holders 16 of track A pass over the row 42 of collecting device 7 of this station 6, eggs will be released which are of the selected characteristics, for example Grade A large, being collected and packed at this station 6. Those eggs having different characteristics will be retained by their respective holders 16 and moved beyond station 6 to subsequent stations 6'. . . **6*n*, any or all of which can be constructed identically to station 6 as described herein. Central processor 2 stores information as to which of the holders in row 42 are empty, so that when a match exists, i.e. an egg intended for station 6 and an empty holder in row 42**, the egg will be released.

As noted, the collecting device 7 is divided centrally into two halves, such that each of the rows 42 through 45 has two end-to-end sets of six holders each. These two sets operate independently of each other. Of course it follows that the transfer conveyor 8, as described in greater detail below, is also divided centrally into two end-to-end sets of holders, wherein each set operates independently of the other but in cooperation with its set of holders of the collecting device 7 above it. Similarly, below each set of holders of the transfer conveyor 8, each set has its own receiving mechanism 9 which operates independently of each other, but cooperates with its corresponding set of holders of the transfer conveyor 8 above it; and of course there is provided below each receiving mechanism 9 a corresponding conveyor 10, wherein the two conveyors 10 operate independently of the other, each cooperating with its corresponding receiving mechanism 9 and set of holders of transfer conveyor 8 located above it.

Thus, in this illustrated embodiment, the station 6 is actually two separate stations which may even handle eggs having different characteristics from each other, but constructed compactly, side-by-side, to save space and reduce costs as compared to two stations totally spaced apart from each other in the conventional manner. It is to be understood, however, that the advantageous features of the present invention, apart from the presently described advantage of compactness, are applicable even if each station 6 has only one set of six holders at each stage, i.e., in the conventional manner, rather than two compact side-by-side sets.

Accordingly, in the following discussion of the structure and operation of the preferred embodiment of the present invention, the discussion will be directed to only one of these two sets, it being understood that the discussion applies equally to the other set.

Figure 7:
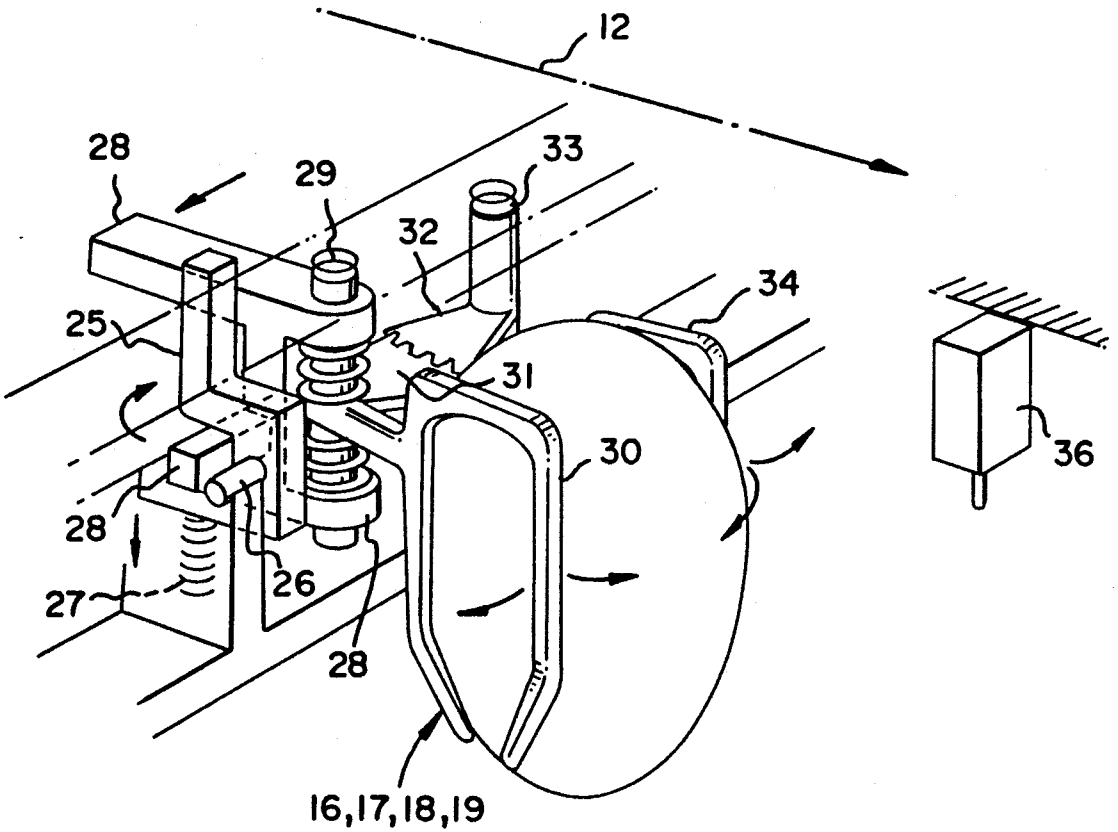
FIG. 7 is an enlarged perspective view of a portion of the apparatus of FIGS. 3–6.

Release of an individual egg from supply conveyor 5 is described with respect to FIGS. 2 and 7. Each of the holder positions in the row 42 have associated with it a solenoid 36, one of which is illustrated in FIGS. 2 and 7. If the central processor 2 knows of a match, i.e. an egg having the selected characteristics and an empty egg holder within row 42, the solenoid 36 associated with that holder will be activated, i.e. its armature moved outwardly (downwardly) such that it will cause release of the appropriate egg passing therebeneath. Referring to FIG. 7, an activated solenoid will engage a post 25 associated with the holder. As the holder 16 moves to the right, the post 25 will slide relatively to the left, turning yoke 28 about an axis through post 29, against the action of a return spring, wherein gear segment 31 and its meshed gear segment 32 associated with post 33 turn towards the egg, wherein the holder elements 30 and 34 separate from each other to release the egg. Meanwhile, spring 27 will urge the post 25 upwardly, blocking the yoke 28 and hence the holder elements 30 and 34 in the open position when receiving a new egg. The holder will remain open until a subsequent location along the conveyor wherein the holder is ready to receive a new egg, at which time the operation of these elements will be reversed so that the holder elements 30 and 34 will converge to hold a new egg.

Figure 9:
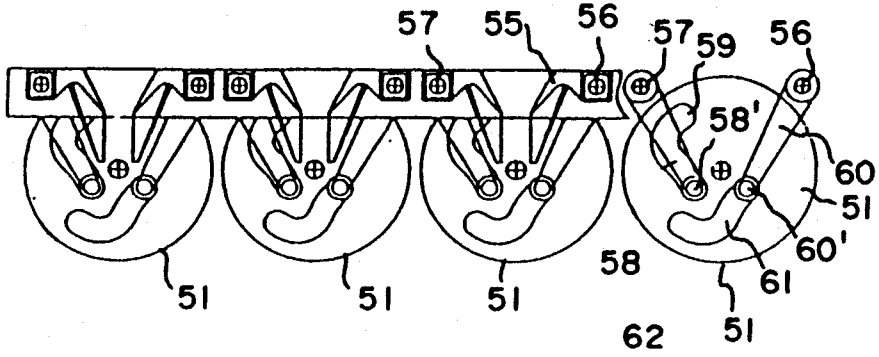
FIG. 9 is a schematic, cross-sectional view taken along line 9—9 of FIG. 8.
Figure 10:
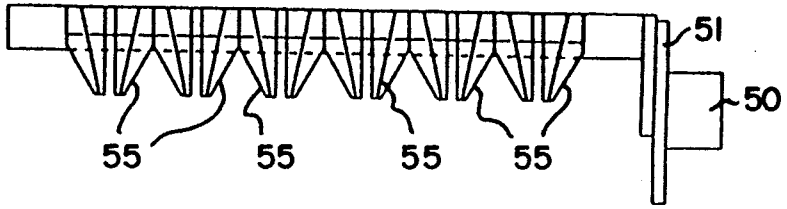
FIG. 10 is a schematic, cross-sectional view taken along line 10—10 of FIG. 8.
Figure 8:
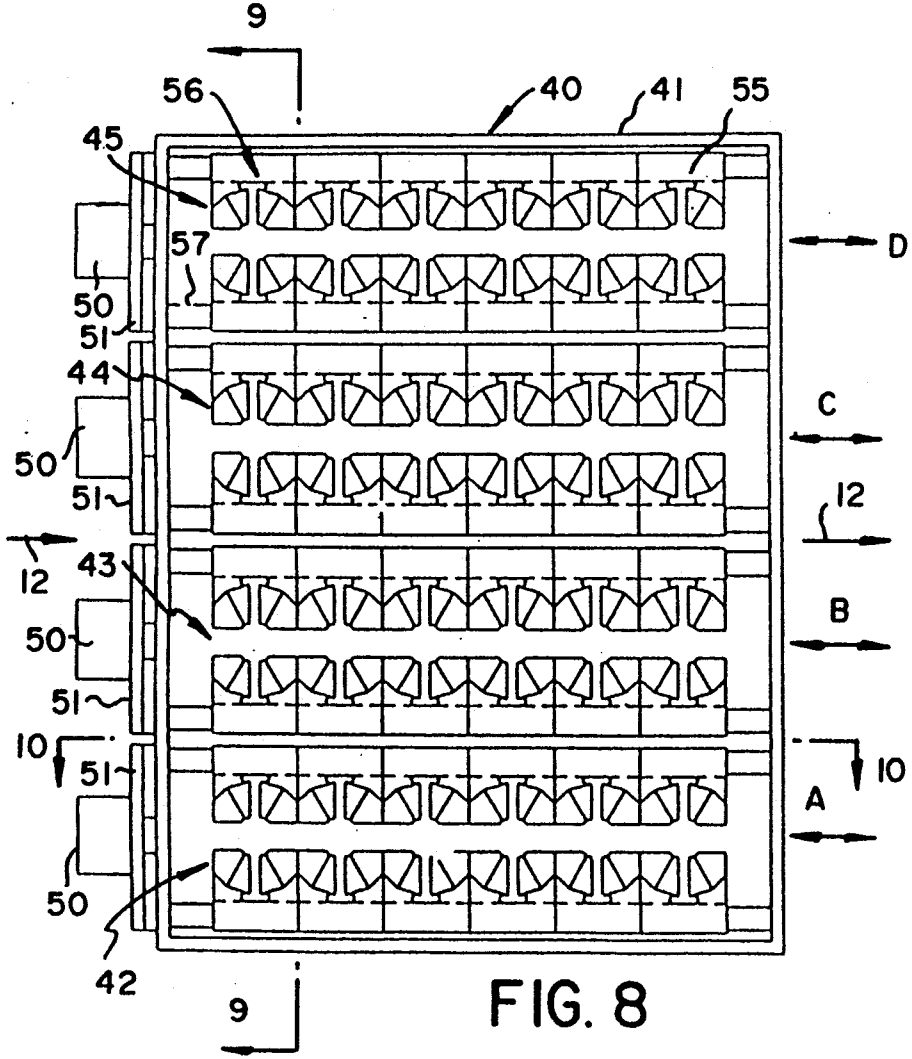
FIG. 8 is a plan view of a portion of the apparatus of FIGS. 3–6.

The set of collecting device 7 on the left side of FIG. 3 is shown in greater detail in FIGS. 8–10. As shown therein, each of the rows comprise six egg holders 55. Referring to FIG. 9, all egg holders of a given row are mounted on shafts 56 and 57 which are pivotable, counterclockwise and clockwise, respectively, to separate the two portions of each holder 55 from each other to release an egg. These shafts are mounted on a cam disk 51 which is operated by a rotary solenoid 50. Referring to FIG. 9, the shaft 57 is mounted on a lever 58, the lower end 58' of which moves in a slot 59 on the cam disk 51. The pivoting shaft 56 is fixed to a lever 60, the lower end 60' of which is received in a slot 61 of the cam disk 51. When cam disk 51 is moved counter-clockwise, as shown by arrow 62, under the action of solenoid 50, the levers 58 and 60 will cause the appropriate movement of pivot shafts 56 and 57 to separate the two halves of their respective holders 5 to release the eggs held therein.

Figure 11:
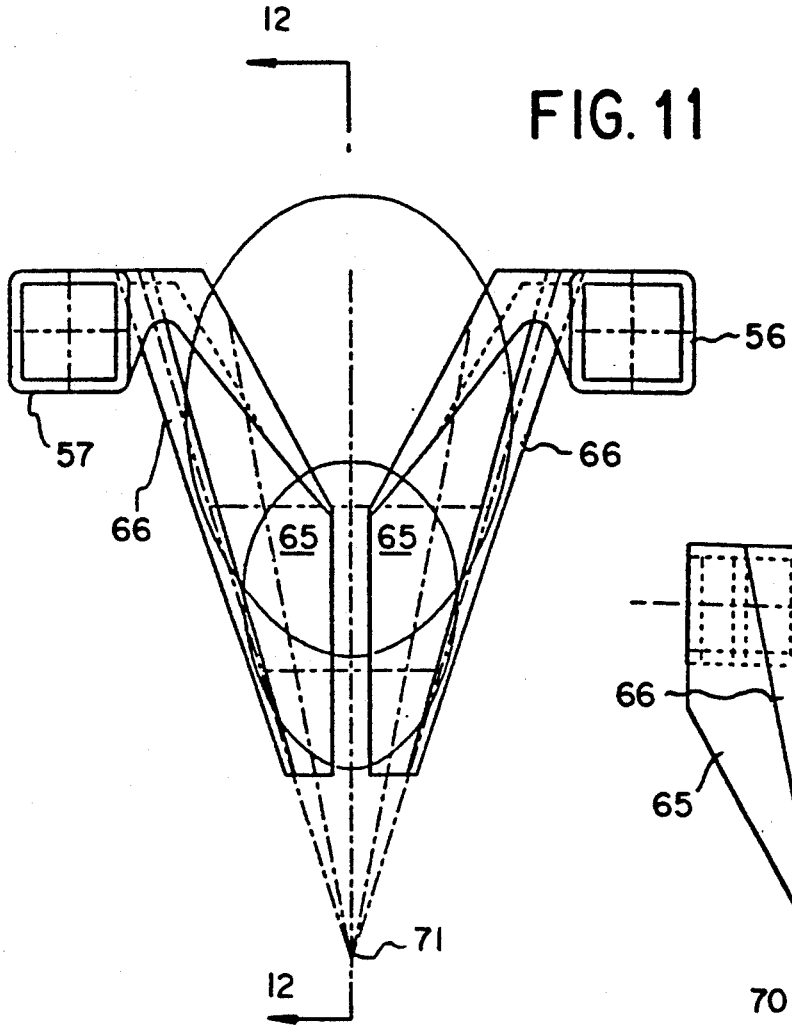
FIG. 11 is an enlarged side elevational view of an article holder of the type used in the apparatus of FIGS. 3–6.
Figure 12:
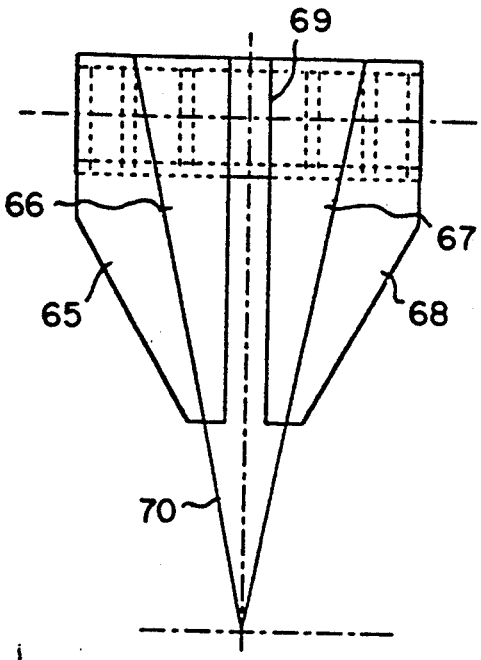
FIG. 12 is an elevational view of the left-hand portion of FIG. 11, taken in the plane of line 12—12 of FIG. 11.
Figure 13:
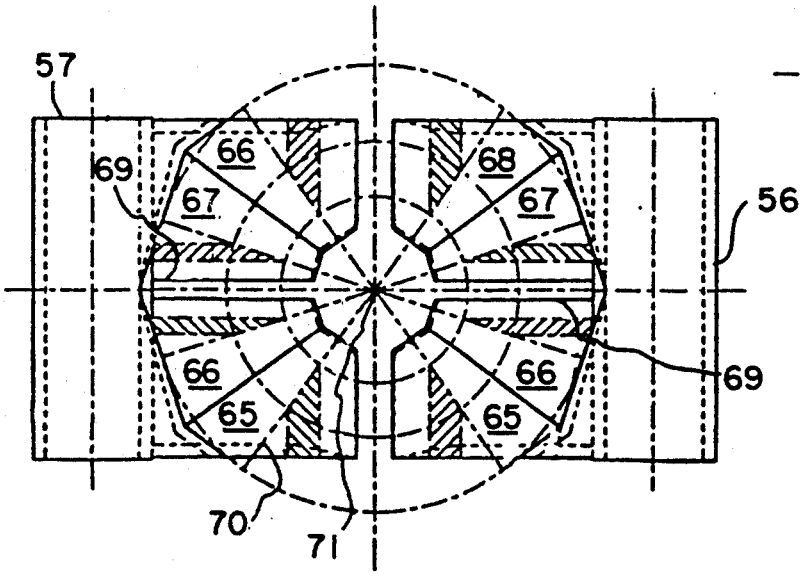
FIG. 13 is a plan view of FIG. 11.

A particularly advantageous feature of the present invention is the new types of holders which are utilized in the respective devices and conveyors 7, 8 and 9. These new holders are shown in detail in FIGS. 11–13. As illustrated therein, these holders 55 are formed in two half members, each of which members is mounted on a pivot shaft 56 or 57 as described above. These members have a plurality of generally flat surfaces 65, 66, 67 and 68, all of which taper uniformly inwardly and downwardly in the shape of an inverted pyramid, as shown by dotted lines 70 towards a common converge point 71. Referring to FIG. 13, each half member of each holder is separated by a slot 69 which assures that each half member has a high degree of resiliency. These holders will be formed of a plastic material to further assure a high degree of resiliency. The eight surfaces of each holder, arranged in pairs, with a total of four slots (two slots 69 and two spaces between opposed halves of the holder) touch an egg essentially at eight points which all lie on a common circle.

A particularly advantageous feature of these holders 55 is that each will receive eggs or other articles quite gently from any direction. Thus, as eggs fall from supply conveyor 5 into the holders 55 of device 7, they are moving parallel to the pivot shafts 56 and 57, such that the initial brunt of the fall would be absorbed by the two end generally flat tapered surfaces 65 or 68. Conversely, as the eggs drop from collecting device 7 into the holders of transfer conveyor 8, the movement of the eggs is in a direction perpendicular to the pivot shafts 56 and 57, meaning that the initial brunt of the fall would, in that case, be absorbed by the middle generally flat surfaces 66 or 67. The same is true with respect to movement of the eggs from the transfer conveyor 8 into the holders of the receiving mechanism 9.

The remainder of the station 6 will be described especially with respect to track A, with an understanding that tracks B, C and D (or any additional tracks) operate identically thereto. Once any set of six holders in either row 42 is complete, and there is an empty set of holders on the transfer conveyor 8 positioned therebeneath, the central processor activates the solenoid 50 at the end of that set of six holders 42 to release the completed row of eggs into the holders of the appropriate set of holders on transfer conveyor 8. A "completed" row will generally mean a full row of six eggs. However, there may be occasions wherein a "completed" row will mean that less than all six article holders of the set contain an egg.

The transfer conveyor 8, as illustrated herein, comprises a pair of sidewalls 75 through which is mounted a shaft 76 for end pulleys 77 (the end pulleys at the other end of transfer conveyor 8 are not shown). The transfer conveyor 8 includes rows 80 of twelve holders 55, said holders being mounted on pivot bars 81 and 82 which support these holders. As in the case of the holders of the collecting device 7, the article holders in each row 80 are divided into two end-to-end sets of six holders each. Each pair of rods 81,82 is supported by brackets 83 and extends inwardly where the rods terminate at a central bearing block 34. Behind each bracket 83, adjacent each side wall, is a release mechanism for each of the rods 81 and 82, which mechanism may be similar to that shown in FIGS. 8 to 10, allowing release of each set of six article holders of the transfer conveyor independently of the other set of article holders along that same row 80. The brackets 83 engages double endless chains 78 so as to assure that the rows of holders 80 remain in the illustrated upright vertical orientation at all locations throughout their complete travel along the endless path of transfer conveyor 8. A mechanism for accomplishing this is shown for example in the Spiegle, U.S. Pat. No. 3,297,139, and since it is known per se, it will be not be further illustrated or described herein.

Once either set of article holders of a row 80 has received a complete row of eggs from any of the sets of holders of rows 42 through 45 of collecting device 7, it brings that set around to the lower run of the endless conveyor 8 for delivery of eggs from that set.

The illustrated embodiment shows the use of a receiving mechanism 9 for receiving the eggs close to the bottom of the lower run of each half of transfer conveyor 8 for more gently lowering the eggs into the containers 95 on conveyor 96. While this mechanism is particularly suitable for fragile articles such as eggs, to prevent breakage thereof, it will be understood that in many applications, especially for less fragile articles such as fruit, the articles may be dropped directly from the lower run of transfer conveyor 8 into the containers, thus eliminating the need for receiving mechanism 9. Another alternative is to use a receiving mechanism 9 which receives eggs from the lower run of the transfer conveyor but does not lower down to the containers. While such an arrangement still requires that the eggs drop a certain distance from the receiving mechanism to the containers, it simplifies the step of dropping the eggs from the lower run of the transfer conveyor since they would be dropped into a stationary receiving mechanism as opposed to being dropped directly from the transfer conveyor to the containers. This latter arrangement might be particularly useful for handling eggs or other articles at lower capacities.

FIG. 6 shows a receiving mechanism 9 having a pair of sets of holders 85 for each half of the transfer conveyor 8. These holders could be identical to holders 55 described above. Each set of holders 85 has its holders mounted on pivot shafts 86 and 87 which are similar to pivot shafts 56 and 57, as described above. In one arrangement, there would be two sets of holders 85, as illustrated in FIG. 6 for each half of the transfer conveyor 8, wherein in FIGS. 3 and 4 only one set is illustrated for purposes of clarity. As illustrated in FIGS. 3, 4 and 5, the ends of shafts 86 and 87 for each set of six holders 85 are mounted on brackets 91 which are fixed to posts 88 which, upon receiving a completed row of eggs are lowered downwardly by downward movement of post 88, which is pivotably connected to a pivoted bar 89 which in turn has a rod at its end spring biased downwardly (not shown) and the position of which is controlled by a cam mechanism 90. For each set of six article holders, a solenoid release mechanism similar to that shown in FIGS. 8 through 10 would be provided (not shown).

Two sets 85 for each half of the transfer conveyor 8 increases the capacity of the receiving and packing station 6 since each of the sets 85 fills a different row of compartments within each container 95. For example, referring to FIG. 6, the left hand set of holders 85 fills the right hand row of compartments of each container 95 while the right hand set 85 fills the left hand row of compartments of each container 95. However, if such high capacity is not required or is economically unfeasible, the invention operates satisfactorily, but at a lesser capacity, by using only one set of holders 85 associated with each half of transfer conveyor 8.

Whether the transfer conveyor 8 delivers directly onto the containers 95 on the conveyor 96, or through the intermediary the receiving mechanism 9, it is of course necessary for the central processor to know the condition of the receiving row, i.e. either of 85 or 95, to assure that the eggs are not released from a set of holders 80 of transfer conveyor 8 unless the receiving row is empty. Referring to FIG. 2, the condition of each set of holders 85 of mechanism 9, as well as the condition of the containers 95 on the conveyor 96, are known and stored in the central processor 2 so that any set 80 will not release its eggs unless the receiving row is empty and available to receive such eggs.

For any number of reasons, either or both receiving rows 85 or 95 might be full of eggs, thus, precluding release of eggs from a given set 80. For example, conditions downstream from either or both conveyors 96 or any other condition in the system as a whole may require that either or both conveyors 96 be temporarily stopped. If this occurs, and if a set 80 cannot deliver eggs into a row 85 or 95, it will retain that row of eggs, carrying same back up to the upper run of the transfer conveyor 8, for delivery upon the next passage along the lower run, and so on, through one or more full revolutions of the transfer conveyor 8. However, since the "full" condition of these sets 80 will be known by the central processor 2, there is no danger that any of the sets of rows 42–45 will deliver a row of eggs into a full set 80. If this "backup" situation continues, the central processor 2, knowing that either half of holders in rows 42–45 of the collecting device 7 are full will not drop eggs from supply conveyor 5 into that half of collecting device 7. When both halves of collecting device 7 are full and unable to drop their eggs because of full sets of article holders 80 in both halves of transfer conveyor 80, the eggs carried by supply conveyor 5 which cannot be deposited at station 6 can be carried to a subsequent stations 6'. . . 6*n* whereat eggs of the same quality and size are being handled. Or alternatively, at some point, of course, the supply conveyor 5 itself would probably be slowed down or stopped until the backup condition was resolved. It will be noted, however, that the receiving and packing stations 6 handles this backup situation automatically without allowing any of the eggs to be mishandled and hence broken.

In a preferred embodiment, the capacity of transfer conveyor 8 would be twice the capacity of the collecting device 7. Because of this large differential in capacity, a backup at either or both of the conveyors 96 can be substantially absorbed by the sets 80 before the backup causes a slowing down of delivery of eggs from corresponding sets of holders of collecting device 7 to the transfer conveyor 8. In this sense, each half of the transfer conveyor 8 acts as a buffer for minimal or immediate slow downs of its respective conveyor 96 without interruption of the collecting device 7 or the supply conveyor 5.

The method of operation of the preferred embodiment of the invention will be apparent from the detailed description above of the apparatus and of its mode of operation. However, for clarity, the method of operation will be briefly summarized herein.

After preliminary steps, articles such as eggs arrive in the vicinity of receiving and packing station 6 with the central processor 2 having stored therein complete knowledge as to the characteristics and location of each egg arriving at that station. A solenoid 36 is associated with each holder within the collecting device 7, in this case there being forty-eight solenoids, namely, twenty-four for each of the right and left halves of collecting device 7. In each half of collecting device 7 one solenoid 50 is provided for each of the set of six holders beneath supply conveyor tracks A, B, C and D. Each of the tracks A, B, C and D of the supply conveyor have a row of holders 16, 17, 18 and 19, respectively, and a row of holders within collecting device 7, namely 42, 43, 44 and 45, respectively or more specifically, two end-to-end sets of six holders in each of these rows 42–45, which sets in each row are operated independently one from the other, such that the right and left side of collecting device 7 can even handle different grades of eggs at the same time. As each egg holder of the supply conveyor 5 passes its respective sets in collecting device 7, if the central processor 2 knows of a "match" i.e. an egg having the selected characteristics for that half of station 6 and an opening in a specific holder of its respective set of holders in device of 7, that egg is released. Meanwhile, eggs having other characteristics not suitable for either half of station 6 will pass by station 6. Also, realizing that the eggs are supplied to conveyor 5 randomly, if a large number of eggs of these selected characteristics for either half of station 6 are close together it might occur that an egg having the selected characteristics for that half will not be released because there may be no "match" since that egg might not arrive over an empty holder in its set of holders in its half of collecting device 7 because there may not have been enough time for the sets of holders in device 7 to have released previously received eggs into a set of open holders of transfer conveyor 8 therebeneath. This might occur also if its set of holders in collecting device 7, even though completed some time ago, has been unable to deliver those eggs to the transfer conveyor 8 because most or all of the sets of holders in its half of transfer conveyor 8 are full, due to a backup in the operation of its respective take away conveyor 96. If this occurs in both halves of station 6, even eggs having the correct selected characteristics will move beyond station 6. They can either be removed at a subsequent station which handles eggs of the same selected characteristics or they will move completely to the end of the conveyor where they will be handled separately.

In any event, given normal operating conditions, once any of the sets of six holders in either half of rows 42–45 of collecting device 7 are completed, the central processor 2 will once again determine if there is an empty set of holders 80 in its half of transfer conveyor 8 passing therebeneath. At that moment, the eggs will be released to the said set 80 of the transfer conveyor 8. In the operation of the illustrated embodiment, as the eggs in a set 80 move to the lower run of the transfer conveyor 8, the central processor 2 will once again determine if there is an empty raised row of holders 85 of its receiving mechanism 9 located therebeneath. Thereafter, the central processor 2, knowing that an empty container row is positioned therebeneath on conveyor 10 will cause the receiving mechanism 9 to move downwardly to containers 95 on its take away container 96 to assure that the eggs are delivered from the rows 85 into the appropriate compartments of the containers 96.

Figure 14:
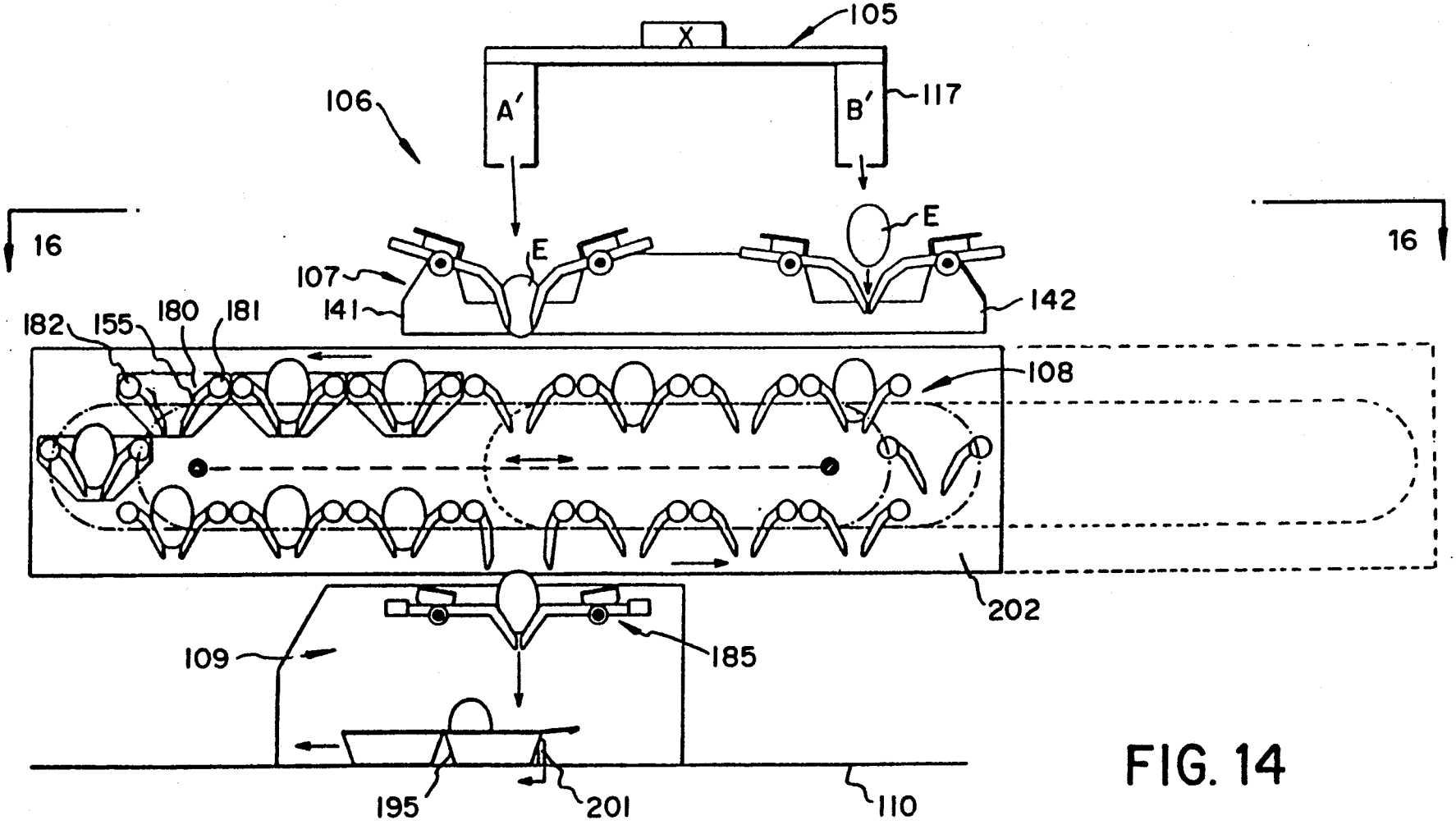
FIG. 14 is a diagrammatic side elevational view of a second embodiment of an article handling system in accordance with the present invention.
Figure 15:
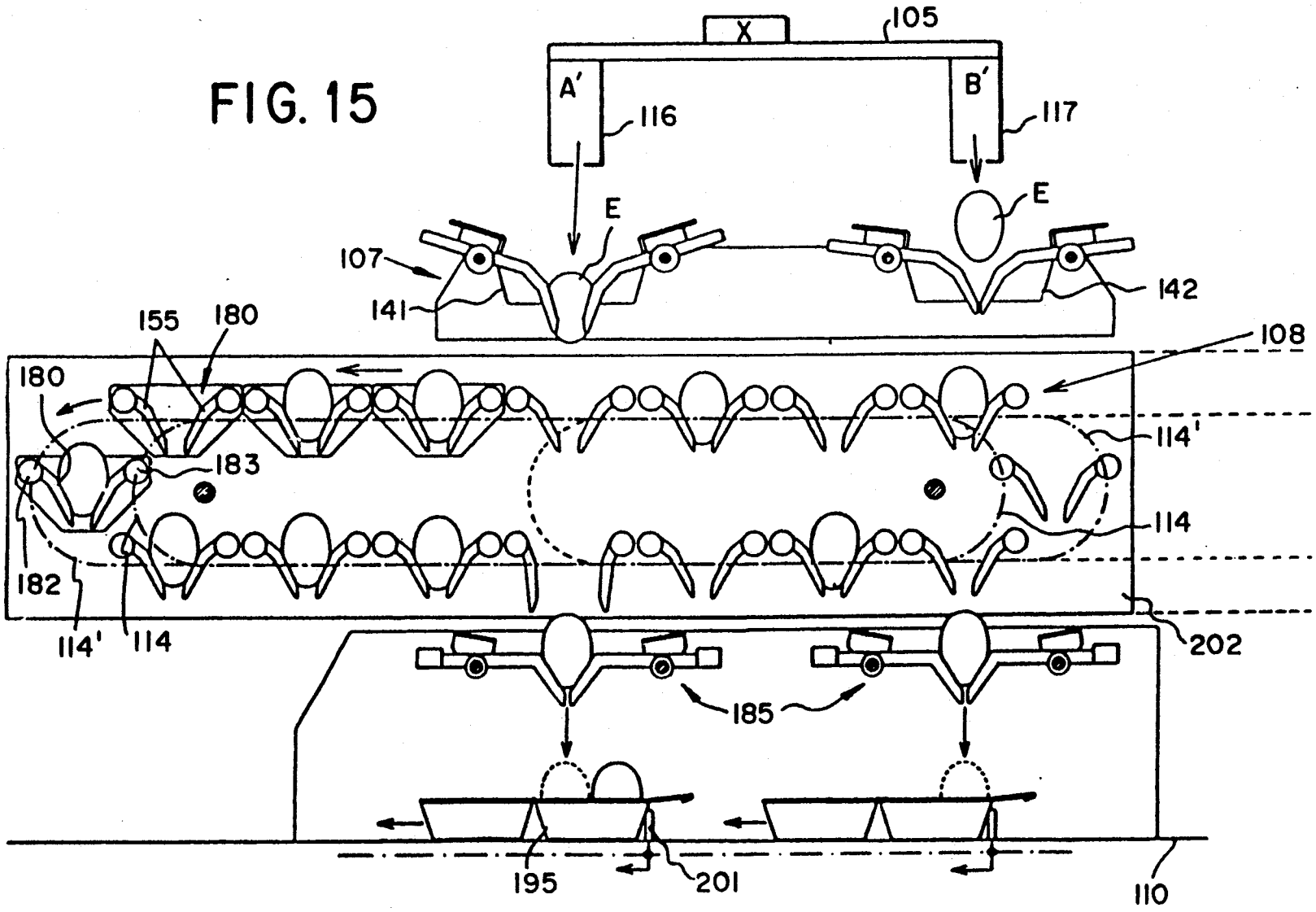
FIG. 15 is a diagrammatic side elevational view similar to FIG. 14 but showing a variation thereof.
Figure 16:
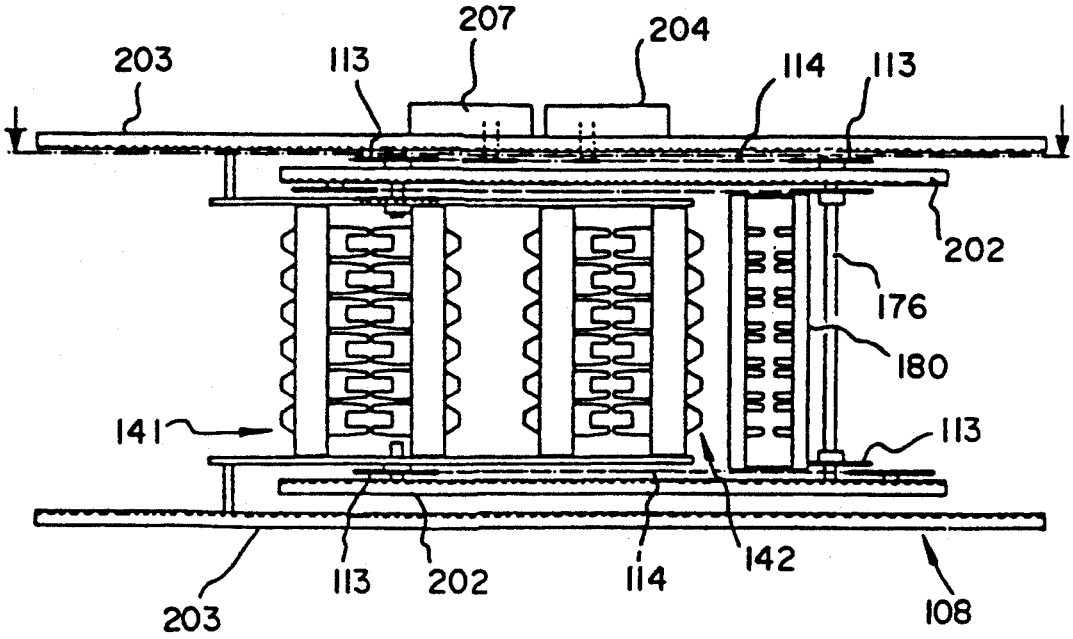
FIG. 16 is a top plan view taken along line 16—16 of FIG. 14.
Figure 17:
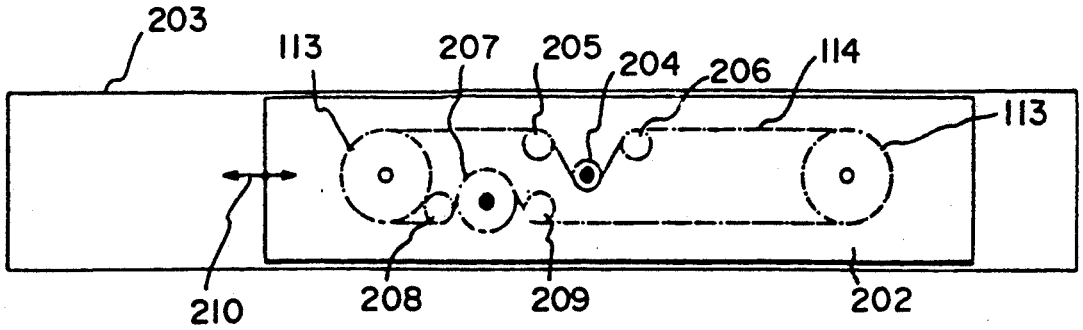
FIG. 17 is a diagrammatic side elevational view of the drive of the transfer conveyor illustrated in FIGS. 14 through 16.

FIGS. 14, 15 and 16 illustrate in highly schematic form a second principle of operation of the present invention, i.e., a second embodiment thereof. Although this embodiment is shown in highly schematic form, it is to be understood that all of the structural features of the preferred embodiment are applicable herein, except as discussed below.

Accordingly, all elements which are generally analogous to counterparts in the preferred embodiment are indicated by the same reference numerals, except raised by 100. Elements which are new to the embodiment of FIGS. 14 through 17 utilize reference numerals above 200.

This second embodiment illustrates a supply conveyor 105 of the type shown in U.S. Pat. No. 4,383,613 having only two tracks A' and B' having holders 116 and 117, respectively. Consequently, there is shown therebelow a collecting device 107 having only two rows of holders 141 and 142 shown receiving eggs E. However, it is to be understood that the second embodiment of the invention, as further described below, can also be utilized with a supply conveyor 5 and a collecting device 7 as shown in FIGS. 2–6. Moreover, the collecting device 107 can have six holders, taken in the direction perpendicular to the plane of FIGS. 14 and 15, i.e., two independently operable sets of six holders, as utilized in the preferred embodiment of the invention.

If the collecting device 107 is of the type having two sets of six holders each, end-to-end, as in the preferred embodiment of the invention, each set can have its own transfer conveyor 108 positioned therebeneath. However, since the transfer conveyors 108 of this second embodiment of the invention have totally different motion characteristics from each other, as to be described below, the two transfer conveyors cannot be integrated with common shafts such as shaft 76 of the preferred embodiment. Rather, each would have to be a completely independent structure from the other. Beneath the or each transfer conveyor 108, this second embodiment could once again duplicate the structures of the first embodiment. More specifically, the receiving mechanism 109 beneath each transfer conveyor 108 can have a single row of six holders 185 which receives the egg from the lower run of the transfer conveyor 108 and drops them into egg containers 195 on conveyor 110, but does not itself move downwardly to the container. In the alternative, this second embodiment can include either of the other two alternatives described with respect to the first embodiment. That is, either the articles can be dropped directly from the lower run of transfer conveyor 108 to the containers or the receiving mechanism 109 may be of the type as shown in the preferred embodiment wherein the holders receive the articles and then move downwardly to bring the articles closer to the containers 195 before releasing them. In the alternative, the receiving mechanism 109 under each transfer conveyor 108 may include a pair of holder rows 185 having the same advantages as described in connection with the first embodiment.

The conveyor 110 and the containers 195 moveable thereon are essentially the same as shown in the first embodiment. The egg containers can be the larger containers as shown in FIG. 3 or the normal consumer containers as shown in FIG. 4. The second embodiment shows a pusher member 201 which is optional and which of course can also be used on the first described embodiment.

Referring now specifically to FIGS. 14 through 17, this second embodiment differs from the first embodiment primarily in the manner of operation of the transfer conveyor 108. Transfer conveyor 108 is equipped with a pair of end pulleys 113 at each end thereof connected by a shaft 176 (one of which is visible in FIG. 16) extending between a pair of opposed carriage side plates 202. The plurality of rows of holders 180 are connected to the chain 114 by suitable means for always maintaining the holder row 180 in an upright orientation, as discussed above with respect to the first embodiment and as shown in U.S. Pat. No. 3,220,154.

The individual holders 155 as shown in the row of holders 180, and for that matter also the holders in the collecting device 107 and the receiving mechanism 109 may all be made the same as the holders 55 as discussed in the first embodiment, including having the release mechanism as shown in FIGS. 8 through 10 rather than the particular shape as shown in FIGS. 14 through 16.

Each transfer conveyor 108 includes a pair of fixed frame members 203. Mounted inwardly thereof is a carriage 202 having opposed side plates. As noted above, the shafts and hence the main portions of the transfer conveyor 108 are mounted on the side plates of carriage 202. The chain 114 located at the top of FIG. 16 is engaged with the positive drive pulleys 204 and 207 which are connected to the frame member 203 at the top of FIG. 16, the drive pulley 204 connected to the upper run of drive chain 114 and the drive pulley 207 connected to the lower run of chain 114. Tension in the drive chain is maintained with tensioning rollers 205 and 206 located adjacent the drive pulley 204 and tension rollers 208 and 209 located adjacent the drive pulley 207. The four tension rollers 205 through 209 are also mounted on the frame side plate 203 at the top of FIG. 16. However, the transfer conveyor pulleys 113 are connected to the side plates of carriage 202 but not to the frame side plates 203. Consequently, if both of the drive pulleys 204 and 207 are driven with different motion characteristics, i.e., a different linear speed is applied to the upper run than is applied to the lower run of chain 114, then the carriage including the two side plates of carriage 202 and the rows of holders 180 located therebetween are caused to move in one horizontal direction or the other, as shown by the arrow 210 in FIG. 17. Dotted lines in FIGS. 14 and 15 illustrate the end positions of the transfer conveyor 108 relative to the frames 203.

The principle of operation of the second embodiment shown in FIGS. 14 through 17 is that the upper run of the transfer conveyor 108 has different motion characteristics than the lower run of this transfer conveyor, this being accomplished by different independent operations of the two separate drive pulleys 204 and 207. For example, if it is desired to have the upper run move continuously and the lower run stop intermittently to release eggs from the holders located on that run, the drive pulley 204 can run continuously while the drive pulley 207 would run at a lower speed or stop. To compensate for the varying movements of the upper and lower runs, the entire transfer conveyor itself including the carriage 202 and the end pulleys 113 would move laterally to the right or left, as the case may be. For example, in this illustration, if the upper run were moving continuously to the right while the lower run was intermittently slowing down or stopping, then obviously the compensation for these varying movements would cause the carriage with the pulleys 113 to move to the left. Conversely, if the lower run of the transfer conveyor was continuous, while the upper run stopped intermittently, for example for receiving eggs from the collecting device 107 into respective holders 180, then the carriage 202 and the pulleys 113 would move to the right.

It will be understood that a virtually unlimited number of variations as between the upper and lower runs of the transfer conveyor 108 can be accomplished, several of which variations are discussed in the summary of the invention above. In each case, varying movement between the two runs will be compensated for by appropriate lateral movement of the carriage 202 and the pulleys 113 connected thereto.

Although the invention has been described with respect to preferred embodiments, it will be apparent that the invention is capable of numerous modifications and variations, apparent to those skilled in the art, without departing from the spirit and scope of the invention.

We claim:

1. A method of transferring discrete articles from a supply conveyor to a take off conveyor, comprising the steps of:

transferring articles from the supply conveyor into article holders of a supply device which has a certain number of article holders arranged parallel to the direction of movement of the supply conveyor, until the article holders of the supply device are completed with a certain number of articles, transferring a completed set of articles from the supply device into an empty row of article holders on a first run of an endless transfer conveyor which also has a second run extending substantially parallel to the first run, wherein the transfer conveyor has a plurality of rows of article holders, all of which rows are moveable along the first and second runs of the transfer conveyor in directions transverse to the direction of movement of the supply conveyor, and delivering completed rows of articles from rows of article holders located along the second run of the transfer conveyor to the take off conveyor.

2. A method according to claim 1, wherein the step of transferring articles from the supply conveyor to the supply device comprises transferring articles from a plurality of parallel tracks of the supply conveyor to separate, respective supply devices arranged parallel to each other, each track of the supply conveyor transferring articles independently of the other track or tracks, and the step of transferring completed rows of articles from the supply device to the rows of article holders of the transfer conveyor comprising transferring articles from all of the supply devices into rows of holders on the first run of the transfer conveyor, wherein articles from all rows of the supply conveyor delivered to the said supply devices are ultimately delivered, via the transfer conveyor, to a common take away conveyor.

3. A method according to claim 1, wherein the supply device is located beneath the supply conveyor and the step of transferring articles from the supply conveyor to the supply device comprises dropping the articles from the supply conveyor to the supply device, the transfer conveyor is positioned beneath the supply device with the first run thereof being an upper run and the second run thereof being a lower run, so that the step of transferring articles from the supply device to the transfer conveyor comprises dropping the articles from the supply device to rows of article holders located on the upper run of the transfer conveyor, and the step of transferring articles from the lower run of the transfer conveyor to the take away conveyor comprises lowering articles from the transfer conveyor to the take away conveyor.

4. A method according to claim 3, including a discharge device located between the lower run of the transfer conveyor and the take away conveyor, and wherein the step of lowering articles from the lower run of the transfer conveyor to the take away conveyor comprises releasing articles to fall from the lower run of the transfer conveyor into rows of article holders in the discharge mechanism, and then lowering the discharge mechanism to lower the articles to containers on the take away conveyor.

5. A method according to claim 4, including a plurality of discharge mechanisms beneath the lower run of the transfer conveyor, and wherein the step of transferring articles from the lower run of the transfer conveyor comprises releasing articles from the lower run thereof into both discharge mechanisms.

6. A method according to claim 5, wherein containers are positioned on the take away conveyor to receive the articles, the containers each having at least two rows of article holding compartments, wherein each discharge mechanism transfers articles to a different row of each container.

7. A method according to claim 3, wherein the articles are eggs.

8. A method according to claim 1, wherein the transfer conveyor has more rows of article holders than there are supply devices supplying it with articles, so that if articles cannot be transferred from the second run of the transfer conveyor, the transfer conveyor acts as a buffer which can continue to receive additional rows of articles from the supply device even while it is unable to transfer articles to the take away conveyor.

9. A method according to claim 8, wherein the undeliverable row of articles continues for at least one additional revolution along the transfer conveyor.

10. An apparatus for transferring discrete articles from a supply conveyor to a take off conveyor, comprising:

a supply conveyor for conveying articles in a row, a supply device positioned adjacent the supply conveyor, said supply device having a certain number of article holders arranged parallel to the direction of movement of the supply conveyor, selected articles being transferable from the supply conveyor to the holders of the supply device, as the supply conveyor moves by the supply device, an endless transfer conveyor positioned adjacent the supply device and having first and second generally parallel runs moveable in directions transverse to the direction of movement of the supply conveyor, said transfer conveyor having a plurality of rows of article holders extending parallel to the row of article holders of the supply device, all of the transfer conveyor rows of article holders being moveable along the first and second runs of the transfer conveyor, the first run thereof being located adjacent the supply device so that each row of article holders of the transfer conveyor is positionable, at one point in its travel, adjacent the supply device for receiving a completed number of articles therefrom and the second run being located to deliver articles to a take away conveyor, and a take away conveyor positioned adjacent the second run of the transfer conveyor to receive articles therefrom.

11. An apparatus according to claim 10, wherein the supply conveyor has a plurality of tracks, each carrying articles, a plurality of article supply devices, each positioned adjacent to and arranged to receive articles from one of the tracks of the supply conveyor, wherein each track of the supply conveyor can transfer articles to its respective supply device independently of the other track or tracks, the first run of the transfer conveyor being positioned to receive articles from all of the plurality of supply devices, such that articles from all tracks of the supply conveyor are ultimately deliverable, via the transfer conveyor, to a common take away conveyor.

12. An apparatus according to claim 10, wherein the supply device is located beneath the supply conveyor such that articles are dropped from the supply conveyor to the article holders of the supply device and the transfer conveyor is located beneath the supply device with the first run thereof being an upper run and the second run thereof being a lower run, such that articles are dropped from the supply device to rows of article holders of the transfer conveyor along the upper run thereof and the take away conveyor is located beneath the lower run of the transfer conveyor.

13. An apparatus according to claim 12, including a discharge device located between the lower run of the transfer conveyor and the take away conveyor for receiving articles from the lower run of the transfer conveyor and lowering such articles to containers on the take away conveyor.

14. An apparatus according to claim 13, including a plurality of discharge mechanisms located beneath the lower run of the transfer conveyor, both of which discharge mechanisms receive articles dropped from the lower run of the transfer conveyor.

15. An apparatus according to claim 14, wherein containers are positioned on the take away conveyor to receive articles, the containers each having at least two rows of holding compartments, each positioned to receive articles from a different one of said discharge mechanisms.

16. An apparatus according to claim 10, wherein the transfer conveyor has more rows of article holders than there are supply devices which deliver articles to it, wherein the transfer conveyor can act as a buffer to receive more articles than it delivers.

* * * * *